US008508156B2

(12) United States Patent
Tsai

(10) Patent No.: US 8,508,156 B2
(45) Date of Patent: Aug. 13, 2013

(54) ENERGY SAVING LED LAMP

(75) Inventor: Ping-Jung Tsai, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 102 days.

(21) Appl. No.: 13/308,552

(22) Filed: Dec. 1, 2011

(65) Prior Publication Data

US 2012/0139427 A1 Jun. 7, 2012

(30) Foreign Application Priority Data

Dec. 6, 2010 (TW) ..... 99142469

(51) Int. Cl.
*G05F 1/00* (2006.01)
*H05B 37/02* (2006.01)
*F21V 21/00* (2006.01)

(52) U.S. Cl.
USPC ..... 315/307; 315/308; 315/154; 362/249.02; 362/642

(58) Field of Classification Search
USPC ..... 315/149–151, 154, 158, 159, 86, 315/307, 308; 362/227, 249.02, 642
See application file for complete search history.

(56) References Cited

U.S. PATENT DOCUMENTS

| | | | | |
|---|---|---|---|---|
| 6,820,998 | B2 * | 11/2004 | Chen | 362/276 |
| 8,100,552 | B2 * | 1/2012 | Spero | 362/231 |
| 8,412,387 | B2 * | 4/2013 | Park et al. | 700/297 |
| 8,449,168 | B2 * | 5/2013 | Hu | 362/642 |
| 2011/0279033 | A1 * | 11/2011 | Yang et al. | 315/86 |

* cited by examiner

*Primary Examiner* — Vibol Tan
(74) *Attorney, Agent, or Firm* — Altis Law Group, Inc.

(57) ABSTRACT

An energy saving LED lamp includes an illuminating device, a mode switching device, a motion detecting device and a controlling unit. The illuminating device is for emitting light. The mode switching device is for switching the illuminating device to work between an illuminating mode and a power saving mode. The motion detecting device is for detecting surrounding human motions and generating a first signal in condition that there is no human motion detected around the LED lamp within a predetermined period of time. The controlling unit is for receiving the first signal generated by the motion detecting device and automatically adjusting brightness of light generated by the illuminating device when having received the first signal, when the mode switching device is at the energy saving mode.

5 Claims, 2 Drawing Sheets

ENERGY SAVING LED LAMP

BACKGROUND

1. Technical Field

The present disclosure generally relates to light emitting diode (LED) lamps, and particular to an energy saving LED lamp with auto power off/dimming function.

2. Description of Related Art

With the continuing development of scientific technology and the raise of people's consciousness of energy saving, LEDs have been widely used in the field of lamp due to their small size and high efficiency. However, in many occasions, it is desirable to be able to turn off the lamp or dim the light intensity of the lamp automatically, thereby achieving further power saving effect.

Therefore, it is necessary to provide an energy saving LED lamp with auto power off/dimming function.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure.

DETAILED DESCRIPTION

Reference will now be made to the drawings to describe the present energy saving LED lamps, in detail.

Figure 1:
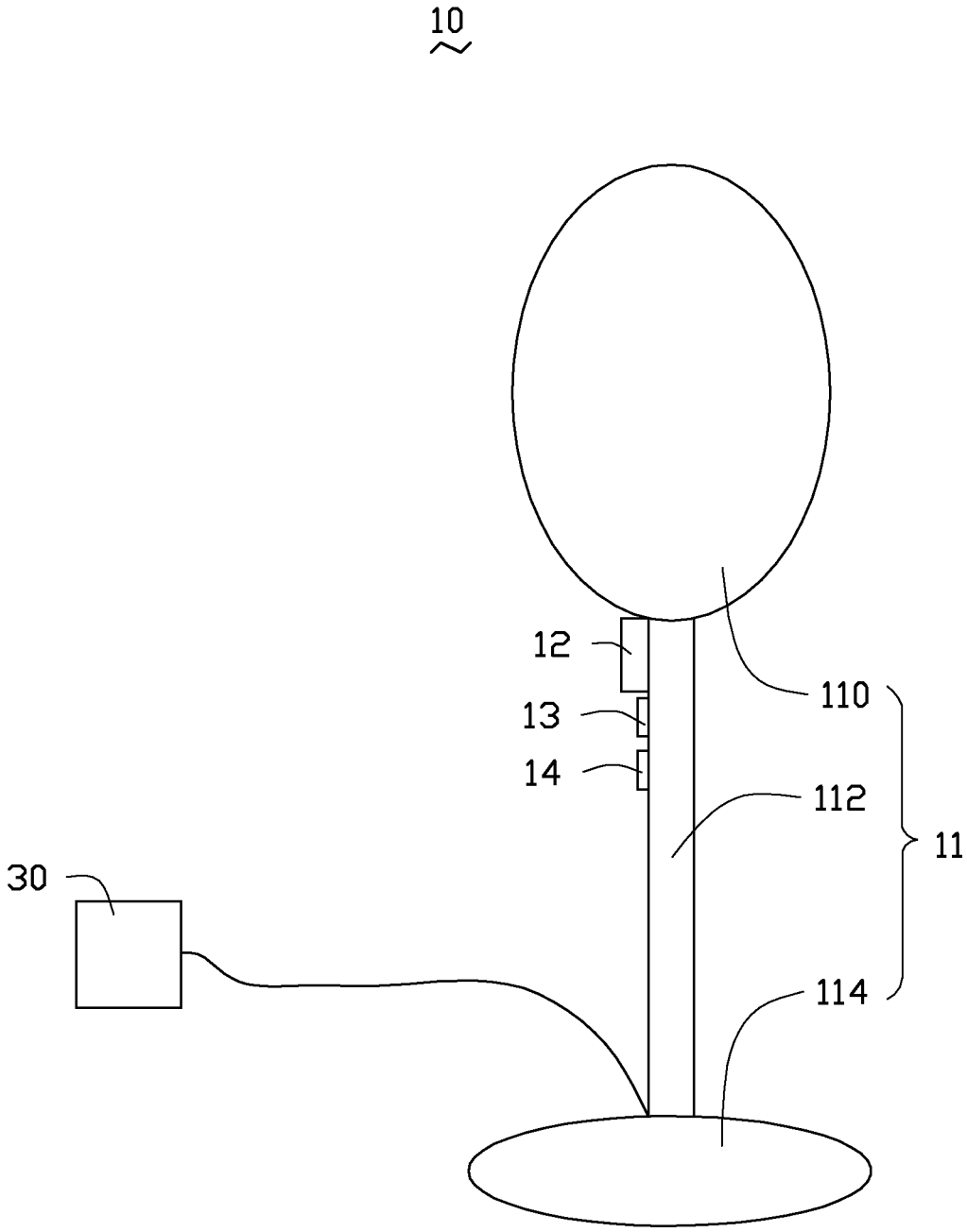
FIG. 1 is a schematic view of an energy saving LED lamp in accordance with a first embodiment of the present disclosure.

Referring to FIG. 1, an energy saving LED lamp 10 according to a first embodiment includes an illuminating device 11, a mode switching device 12, a motion detecting device 13 and a controlling unit 14. The energy saving LED lamp 10 has two working modes: an illuminating mode and a power saving mode. In the illuminating mode, the energy saving LED lamp 10 is used as a conventional lamp, which emits light irrespective of the change of the surrounding environment. Adjustment of light intensity or powered-off of the LED lamp 10 at the illuminating mode is manually achieved. In the power saving mode, the energy saving LED lamp 10 senses whether the user has fallen asleep, and powers off or dims automatically in condition that the user is asleep or the user is absent from the illuminating range of the LED lamp 10.

The illuminating device 11 can be connected to an external power supply 30, thereby emitting light for proper illumination. In this embodiment, the illuminating device 11 includes a lamp cover 110, a lamp pole 112 and a lamp base 114. The lamp cover 110 receives a plurality of LEDs therein.

The mode switching device 12 is configured for switching the illuminating device 11 to work under the illuminating mode or the power saving mode. The mode switching device 12 can be arranged on the lamp cover 110, the lamp pole 112, or the lamp base 114. In this embodiment, the mode switching device 12 is arranged on the lamp pole 112, with a suitable height for manual operation.

The motion detecting device 13 is for detecting surrounding human motions when the energy saving LED lamp 10 is working in a power saving mode. The motion detecting device 13 can be arranged on the lamp cover 110, the lamp pole 112, or the lamp base 114. In this embodiment, the motion detecting device 13 is arranged on the lamp pole 112. In condition that there is no human motion detected around the LED lamp within a predetermined period of time, it can be concluded that there is no human being around the LED lamp 10 or the user(s) of the LED lamp 10 has fallen asleep, and the motion detecting device 13 generates a first signal to the controlling unit 14. In condition that there is still human motion can be detected, it can be concluded that the LED lamp 10 is being used and the user(s) is still awake, and the motion detecting device 13 stands by and keeps on detecting surrounding human motions.

In detail, the motion detecting device 13 can be a video motion detector, thereby capable of sensing ranges of human motions. In view of that some people still make small ranges of motions during sleeping, a sensitivity of the motion detecting device 13 can be adjusted correspondingly to avoid misjudgment. As such, in condition that there are small ranges of motions detected, it is still concluded that the surrounding user(s) has fallen asleep, and the motion detecting device 13 generates a first signal to the controlling unit 14.

The controlling unit 14 is configured for adjusting brightness of the illuminating device 11 after having received the first signal of the motion detecting device 13. In detail, the controlling unit 14 is configured for powering off or dimming the illuminating device 11 after having received the signal generated from the motion detecting device 13. The controlling unit 14 can be arranged on the lamp cover 110, the lamp pole 112, or the lamp base 114. In this embodiment, the controlling unit 14 is arranged on the lamp pole 112. When there is no signal generated by the motion detecting device 13, the controlling unit 14 keeps stand by. When having received the first signal generated by the motion detecting device 13, the controlling unit 14 powers off the illuminating device 11.

In addition, the controlling unit 14 is not limited to only power off the illuminating device 11 after having received the first signal; the controlling unit 14 can also dim the illuminating device 11 till the illuminating device 11 powers off.

Due to that the motion detecting device 13 is employed for detecting human motions around and the controlling unit 14 is employed for powering off or dimming the illuminating device 11, an automatic power off/dimming function of the energy saving LED lamp 10 is achieved.

Figure 2:
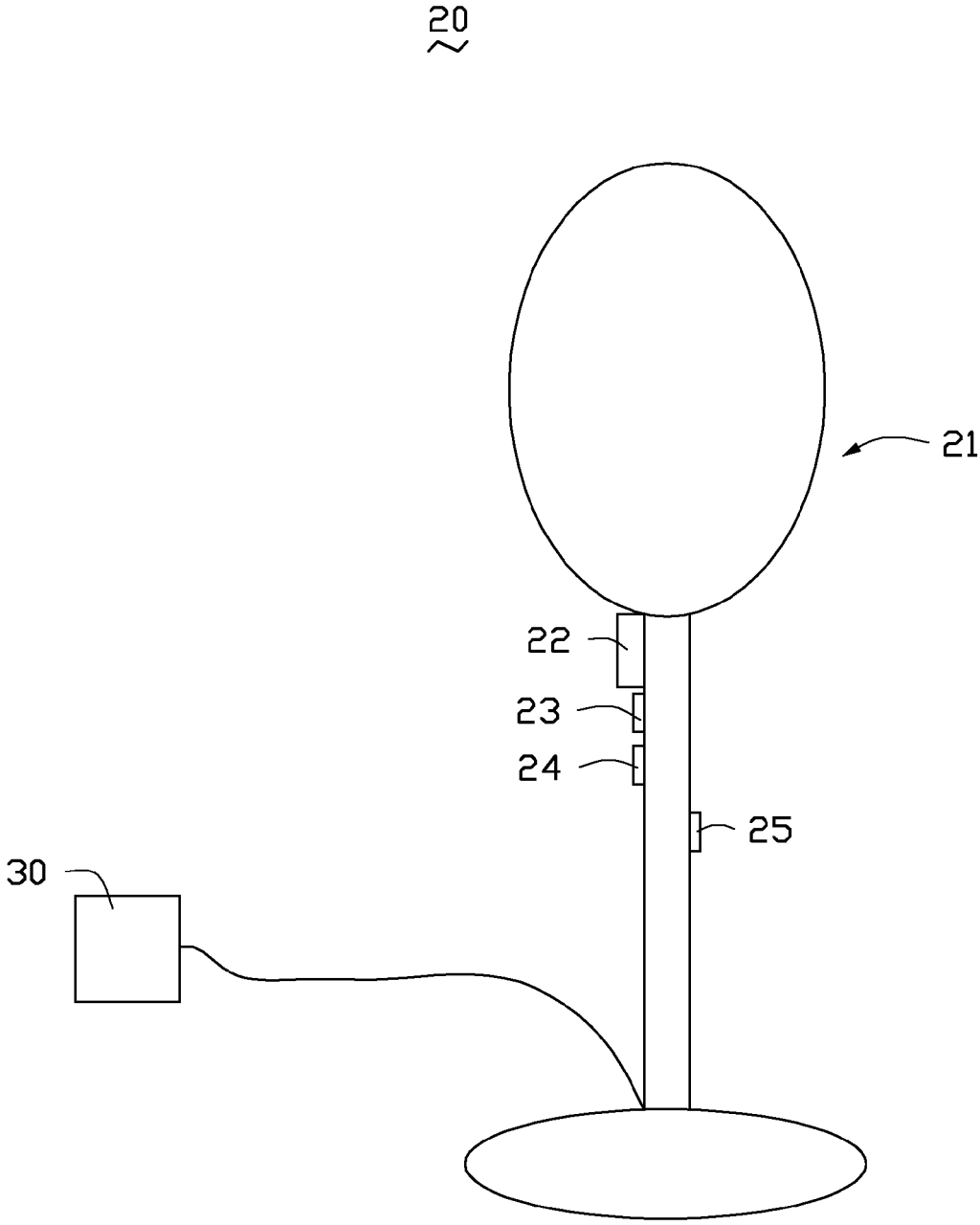
FIG. 2 is a schematic view of an energy saving LED lamp in accordance with a second embodiment of the present disclosure.

Referring to FIG. 2, an energy saving LED lamp 20 according to a second embodiment is provided. Similar to the energy saving LED lamp 10 of the first embodiment, the energy saving LED lamp 20 also includes an illuminating device 21 for emitting light, a mode switching device 22 for switching the illuminating device 21 to work in an illuminating mode or a power saving mode, a motion detecting device 23 for detecting human motions around the LED lamp 20 and a controlling unit 24 for receiving a signal generated by the motion detecting device 23.

Differently from the to energy saving LED lamp 10 of the first embodiment, the motion detecting device 23 is further capable of generating a second signal in condition that there is a large motion of the user being detected.

The motion detecting device 23 generates a first signal to the controlling unit 24 when: (a) small ranges of human motions are detected by the motion detecting device 23; or (b) no human motion is detected by the motion detecting device 23. Accordingly, when receiving the first signal generated by the motion detecting device 23, the controlling unit 24: (a) dims the illuminating device 21, or (b) powers off the illuminating device 21; or (c) gradually dims the illuminating device 21 till the illuminating device 21 powers off.

In addition, the motion detecting device 23 generates a second signal to the controlling unit 24 when big ranges of human motions are detected by the motion detecting device 23. Accordingly, when receiving the second signal generated by the motion detecting device 23, the controlling unit 24: (a) controls the illuminating device 21 to emit light with increased intensity, or (b) powers on the illuminating device 21, or (c) powers on the illuminating device 21 and controls the illuminating device 21 to emit light with gradually increased intensity.

Furthermore, the energy saving LED lamp 20 can also be equipped with a sunlight detecting device 25. As such, the illuminating device 21 of the energy saving LED lamp 20 can be powered off by the controlling unit 24 when the sunlight detecting device 25 has detected an existence of sunlight with sufficient brightness and sends a corresponding signal to the controlling unit 24.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An energy saving LED lamp comprising:

an illuminating device for emitting light;

a mode switching device for switching the illuminating device to work between an illuminating mode for which the illuminating device needs a manual operation to be changed from an illumination condition to another condition and a power saving mode for which the illuminating device is automatically changed from an illumination condition to another condition;

a motion detecting device for detecting surrounding human motions, the motion detecting device generating a first signal in condition that there is no human motion detected around the LED lamp within a predetermined period of time; and a controlling unit for receiving the first signal generated by the motion detecting device and controlling the illuminating device to automatically change from the illumination condition to the another condition after having received the first signal when the mode switching device is at the power saving mode.

2. The energy saving LED lamp according claim 1, wherein the another condition when the mode switching device is at the power saving mode is that the illuminating device is turned off.

3. The energy saving LED lamp according claim 1, wherein the another condition when the mode switching device is at the power saving mode is that the illuminating device is dimmed.

4. The energy saving LED lamp according claim 1, wherein the motion detecting device generates a second signal in condition that there are human motions detected around the LED lamp, and the controlling unit controls the illuminating device to emit light with increased illumination intensity when receiving the second signal after the illuminating device has changed from the illumination condition to the another condition when the mode switching device is at the power saving mode.

5. The energy saving LED lamp according claim 1, further comprising a sunlight detecting device, the controlling unit powering off the illuminating device when the sunlight detecting device has detected an existence of sunlight with a sufficient brightness.

* * * * *